US005483210A

United States Patent [19]

Otterberg et al.

[11] Patent Number: 5,483,210

[45] Date of Patent: Jan. 9, 1996

[54] MECHANICAL GUIDANCE SYSTEM FOR SWITCHER INTERRUPTER AND METHOD FOR ASSEMBLING THE SAME

[75] Inventors: Tomas B. Otterberg, Murrysville, Pa.; Markus Vestner, Buesingen, Switzerland

[73] Assignee: ABB Power T&D Company Inc., Raleigh, N.C.

[21] Appl. No.: 225,238

[22] Filed: Apr. 8, 1994

[51] Int. Cl.[6] ..... H01H 73/00

[52] U.S. Cl. ..... 335/18; 335/202

[58] Field of Search ..... 339/78–87, 18, 339/126, 131, 185–190, 200, 202; 361/42–50

[56] References Cited

U.S. PATENT DOCUMENTS

| | | | |
|---|---|---|---|
| 4,706,153 | 11/1987 | Sainomoto et al. | 361/42 |
| 5,013,891 | 7/1991 | Shoemaker | 219/385 |
| 5,124,679 | 6/1992 | Kanazawa | 335/18 |

*Primary Examiner*—Lincoln Donovan
*Attorney, Agent, or Firm*—Woodcock, Washburn, Kurtz, Mackiewicz & Norris

[57] ABSTRACT

A guidance system for an interrupter switcher comprising a first guide positioned in between the contact support and the movable contact system of the interrupter, and a second guide inserted into the stationary contact system of the interrupter. According to the invention the second guide is capable of receiving the nozzle of the movable contact system. An interrupter with the guidance system is assembled by positioning the first guide between the contact support and the movable contact system, positioning the second guide within the stationary contact system, inserting the nozzle of the movable contact system into the second guide, and mounting the stationary contact system in the interrupter housing. The assembly of an interrupter with a guidance system results in a self-adjusting switcher interrupter capable of maintaining a stable alignment between the interrupter's movable and stationary contacts while opening and closing the interrupter.

16 Claims, 4 Drawing Sheets

MECHANICAL GUIDANCE SYSTEM FOR SWITCHER INTERRUPTER AND METHOD FOR ASSEMBLING THE SAME

FIELD OF THE INVENTION

The present invention relates to a guidance system for use in an interrupter and, more particularly, relates to the use of guide rings for guiding a movable contact system of the interrupter.

BACKGROUND OF THE INVENTION

A preferred application for the present invention is in high voltage alternating current (AC) circuit breakers and reclosers, the latter being a type of circuit breaker. Therefore, the background of the invention is described below in connection with such devices. However, it should be noted that, except where they are expressly so limited, the claims at the end of this specification are not intended to be limited to applications of the invention in high voltage AC circuit breakers or reclosers.

A high voltage circuit breaker is a device used in the distribution of three phase electrical energy. When a sensor or protective relay detects a fault or other system disturbance on the protected circuit, the circuit breaker operates to physically separate current-carrying contacts in each of the three phases by opening the circuit to prevent the continued flow of current. A recloser differs from a circuit breaker in that a circuit breaker opens a circuit and maintains the circuit in the open position indefinitely, whereas a recloser may automatically open and reclose the circuit several times in quick succession to allow a temporary fault to clear and thus, avoid taking the circuit out of service unnecessarily.

A major component of a circuit breaker or recloser is an interrupter. Typically, a circuit breaker will include one or more interrupters which function to open and close one or more sets of current carrying contacts housed within the interrupter. A longitudinal cross section of an interrupter 10 is shown in FIGS. 1, 2, and 3. The interrupter 15 shown within a housing 30. A movable contact system 11 and a stationary contact system 13 are shown to have two sets of contacts, the arcing contacts 12 and 14 and the main contacts 15 and 19, respectively. The stationary contact system is typically mounted to the housing 30. The movable contact system 11 is operationally connected to a driving mechanism of the circuit breaker (not shown) which can cause the movable contact system to move along the contact support 20 to open and close the circuit breaker. The contact support 20 surrounds the exhaust tube 26 :which is operatively connected to housing 30. Arcing contact 12 and main contact 19 of the movable contact system are moved along the contact support 20 to either close the circuit with respective contacts 14 and 15 or to open the circuit, FIG. 1 shows a longitudinal cross sectional view of the interrupter with its contacts closed, whereas FIG. 3 shows a longitudinal cross section of the interrupter with the contacts open.

The arcing contacts 12 and 14 of high voltage circuit breaker interrupters are subject to arcing or corona discharge when they are opened or closed, respectively. As shown in FIG. 2, an arc 16 is formed between arcing contacts 12 and 14 as they are moved apart. Such arcing can cause the contacts to erode and perhaps to disintegrate over time. Therefore, a known practice (used in a "puffer" interrupter) is to fill a cavity of the interrupter with an inert, electrically insulating gas that quenches the arc 16. As shown in FIG. 2, the gas is compressed by piston 17 and a jet or nozzle 18 is positioned so that, at the proper moment, a blast of the compressed gas is directed toward the location of the arc in order to extinguish it. Once an arc has formed, it is extremely difficult to extinguish it until the arc current is substantially reduced. Once the arc is extinguished, the protected circuit is opened, as shown in FIG. 3, to prevent current flow.

When the interrupter is opened as shown in FIG. 2, hot gases are formed. If the hot gases are permitted to pass through the interface between the movable and stationary contact systems and enter the region of the main contacts 15 and 19, the interrupter can fail. Therefore, the nozzle 28 of the movable contact system must provide a good seal with the stationary contact system 13.

Another cause of contact erosion results from the movement of the contacts against one another as the interrupter is opened and closed. To reduce contact erosion caused by the movement of the contacts, it is desirable to stabilize the alignment between the contacts of the movable contact system and the contacts of the stationary contact system while the movable contact system is guided along the contact support to open the circuit. If the contacts are not aligned to provide a stable interface therebetween, they may erode quicker or become damaged by excessive contact pressure at the interface.

A guidance system comprising two guides 22 and 24 is typically utilized to improve the stability of the alignment between the movable contact system and the stationary contact system. The first guide is typically inserted between the contact support 20 and the movable contact system 11 as shown in FIGS. 1, 2 and 3. The second guide 24 is typically inserted between the contact support 20 and the exhaust tube 26. The first guide 24 fills in any gaps between the movable contact system 11 and the contact support 20 so that the movable contact system 11 has a more stable alignment with the contact support 20. Similarly, the second guide 24 secures exhaust tube 26 and the contact support 20 so that the contact support 20 remains fixed during the interrupter operation.

In order to provide a stable alignment between the movable contact system and the stationary contact system, the stationary contact system is usually mounted to the housing 30 so that the movable and stationary contact systems are critically aligned. Traditionally, a person assembling the interrupter aligns the movable and stationary contact system manually using a trial and error process. Determining this critical alignment manually is both time consuming and subject to error. Moreover, even when the critical alignment is determined in such a manner, error may be introduced during the mounting of the stationary contact system itself.

A stable alignment between the stationary contact system 13 and the movable contact system 11 is desired to maintain the electrical integrity of the switch or circuit breaker. An electrical field is formed between the nozzle 28 and the main contact 15 of the stationary contact system. When the interrupter is in the open position, a misalignment between the movable contact system and the stationary system increases the electric field stress and increases the risk of flashover.

Therefore, there is a need for a guidance system capable of providing a self-adjusting stable alignment between the movable contact system and the stationary contact system in an interrupter.

SUMMARY OF THE INVENTION

The present invention fulfills this need by providing a guidance system for use in an interrupter comprising a first guide for guiding the movable contact system relative to the contact support, and a second guide for guiding the movable contact system relative to the stationary contact system so that the interface between the movable contact system and the stationary contact system remains stable. Preferably the movable contact system comprises a nozzle formed from an insulating material and the stationary contact system comprises an arcing contact such that when the movable contact system is interfaced with the stationary contact system an electric field forms between the arcing contact and the nozzle. In this preferred embodiment, the first and second guides substantially stabilize the electric field while the movable contact system is guided along the contact support.

According to the invention, the first guide is inserted between the contact support and the movable contact system so that the movable contact system is capable of being slidably moved along the contact support to provide a substantially fixed alignment therebetween. Preferably, the second guide is substantially fixed to the stationary contact system to receive the nozzle to align the movable contact system with the stationary contact system while the movable contact system is guided along the contact support.

In a more preferred embodiment, the first and second guides are substantially ring shaped. In this preferred embodiment, the second guide is insertably fixed inside the main contact of the stationary contact system to receive the nozzle so that the main and arcing contacts of the movable contact system and the main and arcing contacts of the stationary contact system are substantially aligned when the movable contact system is guided along the contact support.

A method for assembling an interrupter having a guidance system according to the invention is also provided. According to the inventive method, a first guide is positioned between a movable contact system and a contact support, a second guide is inserted into an opening of a stationary contact system, and then the movable contact system is placed within the second guide to align the movable contact system with the stationary contact system. In a preferred embodiment, the movable contact system is operatively connected to a driving mechanism. The contact support is preferably adjustably disposed along a longitudinal axis of the interrupter and the stationary contact system is preferably secured at the end of the interrupter housing so that the alignment between the stationary contact system and the movable contact system is self-adjusting.

The first and second guides are preferably ring shaped. In a more preferred embodiment, the second guide is insertably fixed inside the main contact of the stationary contact system to receive the nozzle so that the main and arcing contacts of the movable contact system and the main and arcing contacts of the stationary contact system are substantially aligned when the movable contact system is guided along the contact support.

A switch interrupter comprising: a contact support; a movable contact system positioned to move along the contact support; a first guide disposed between the contact support and the movable contact system to align the movable contact system with the contact support; a stationary contact system for receiving the movable contact system; and a second guide substantially fixed to the stationary contact system to align the movable contact system with the stationary contact system is also provided by the invention. The first and second guides are preferably rings formed from a substantially insulating material.

BRIEF DESCRIPTION OF THE DRAWINGS

The present invention will be better understood, and its numerous objects and advantages will become apparent by reference to the following detailed description of the invention when taken in conjunction with the following drawings, in which.

DETAILED DESCRIPTION OF THE INVENTION

Figure 1:
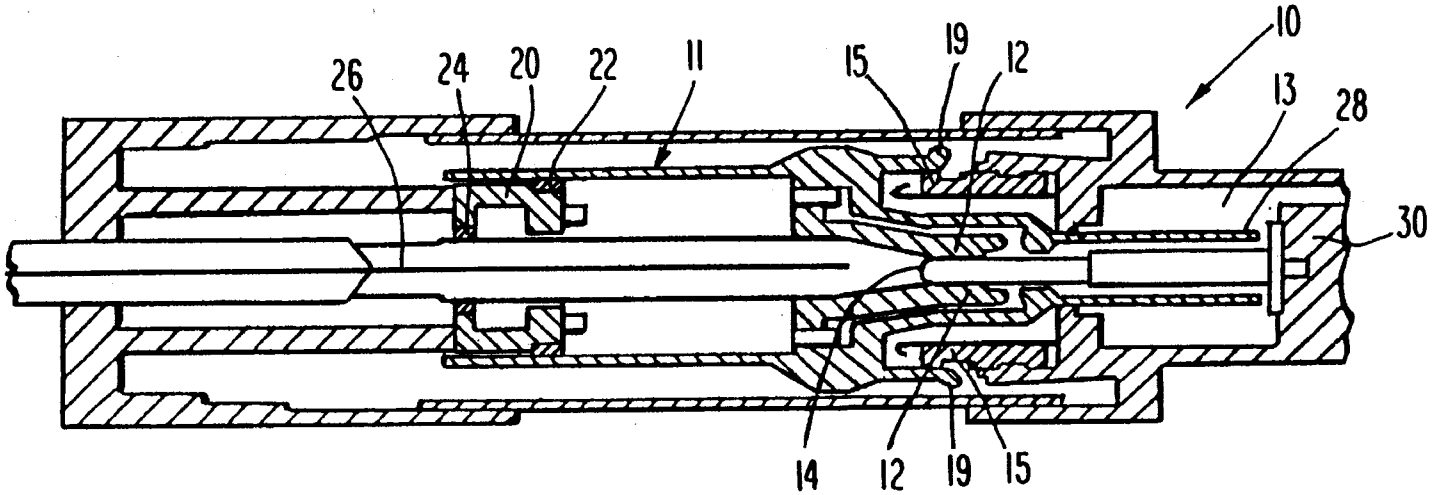
Fig. 1 PRIOR ART
FIG. 1 is a longitudinal cross section of an interrupter in a closed position according to the prior art.
Figure 2:
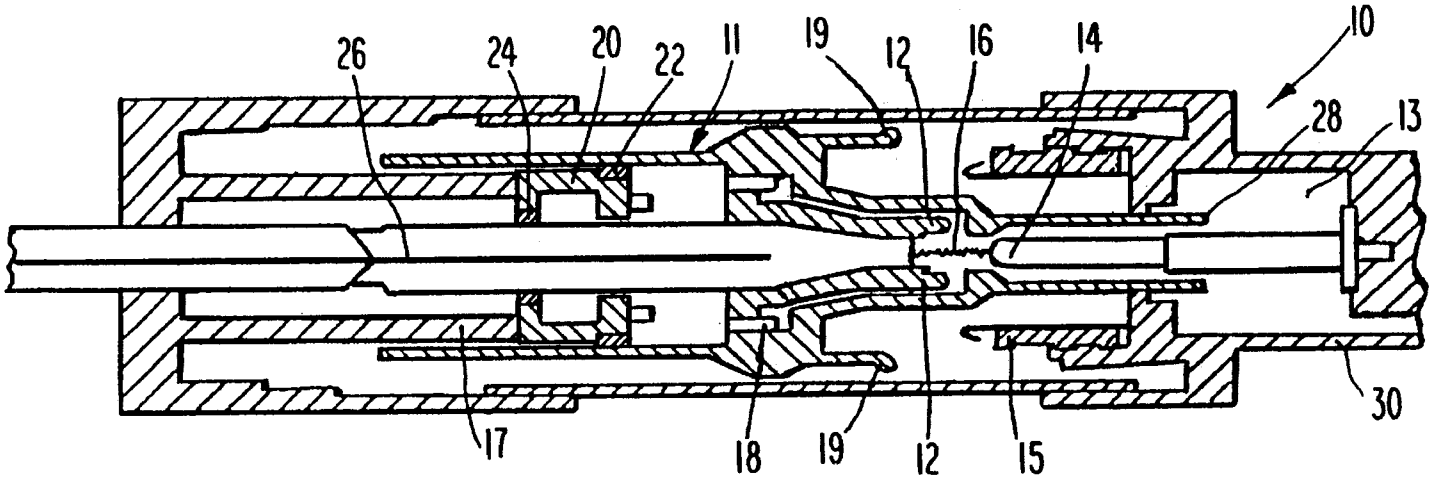
Fig. 2 PRIOR ART
FIG. 2 is a longitudinal cross section of an interrupter showing an arc formation according to the prior art.
Figure 3:
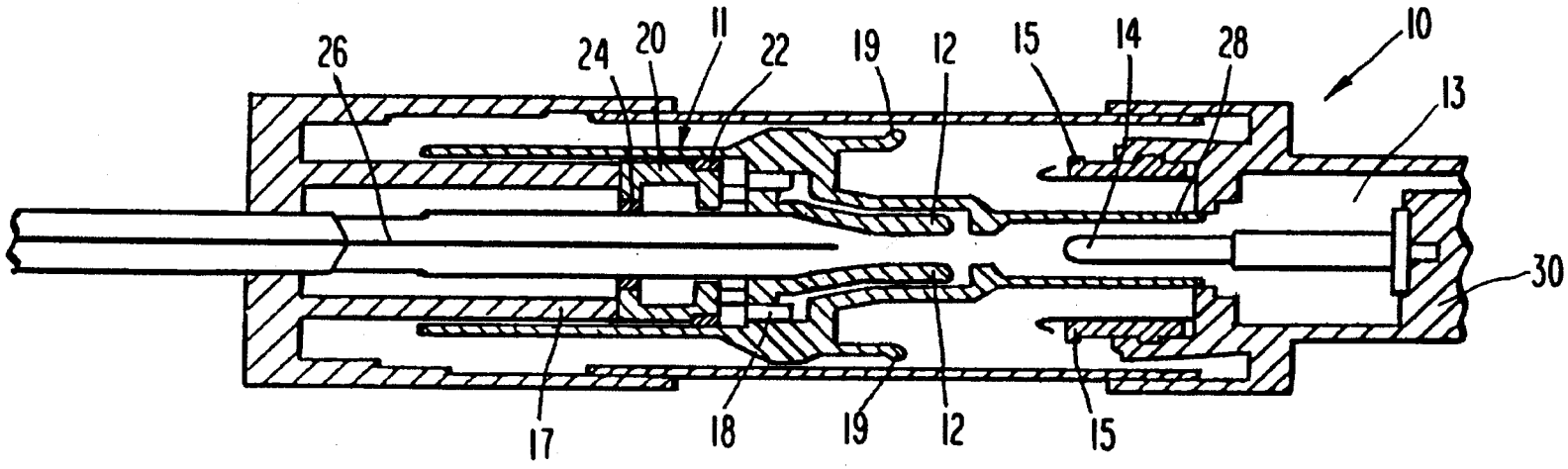
Fig. 3 PRIOR ART
FIG. 3 is a longitudinal cross section of an interrupter in the open position according to the prior art.
Figure 4:
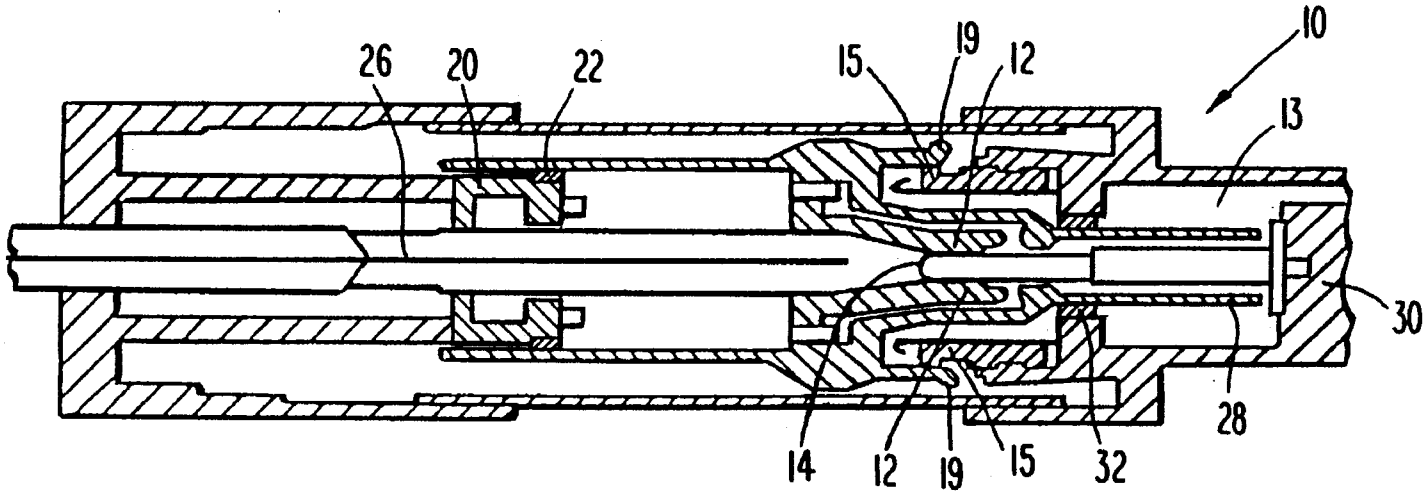
FIG. 4 is a longitudinal cross section of an interrupter with a guidance system according to the present invention in a closed position.
Figure 5:
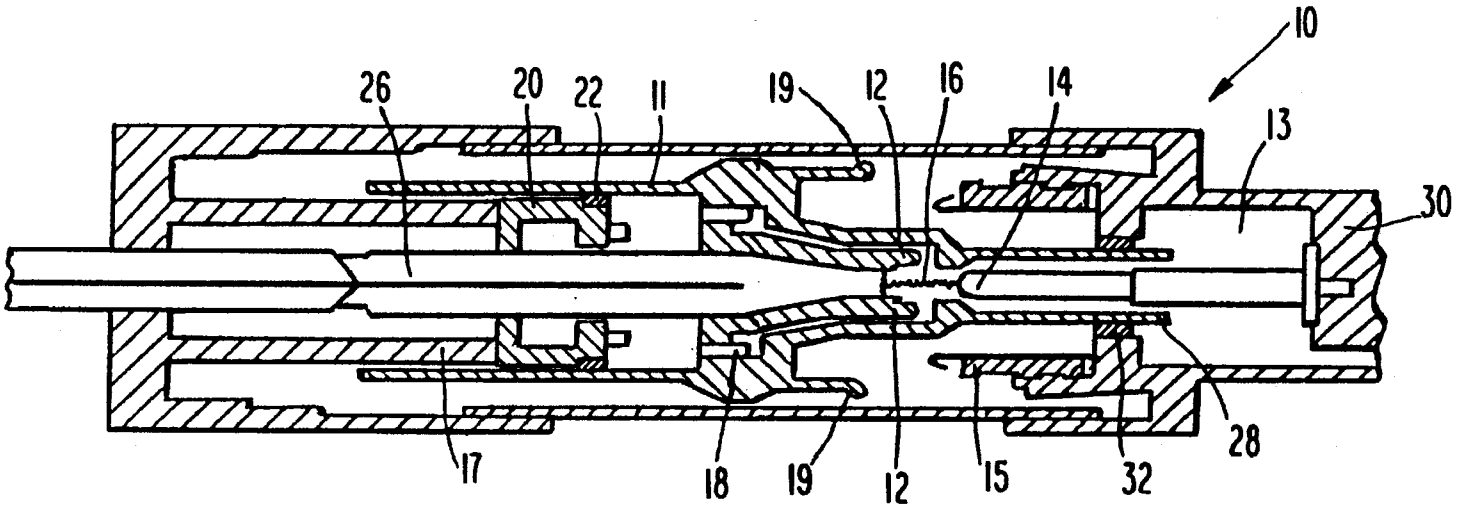
FIG. 5 is a longitudinal cross section of an interrupter with a guidance system according to the present invention showing an arc formation.
Figure 6:
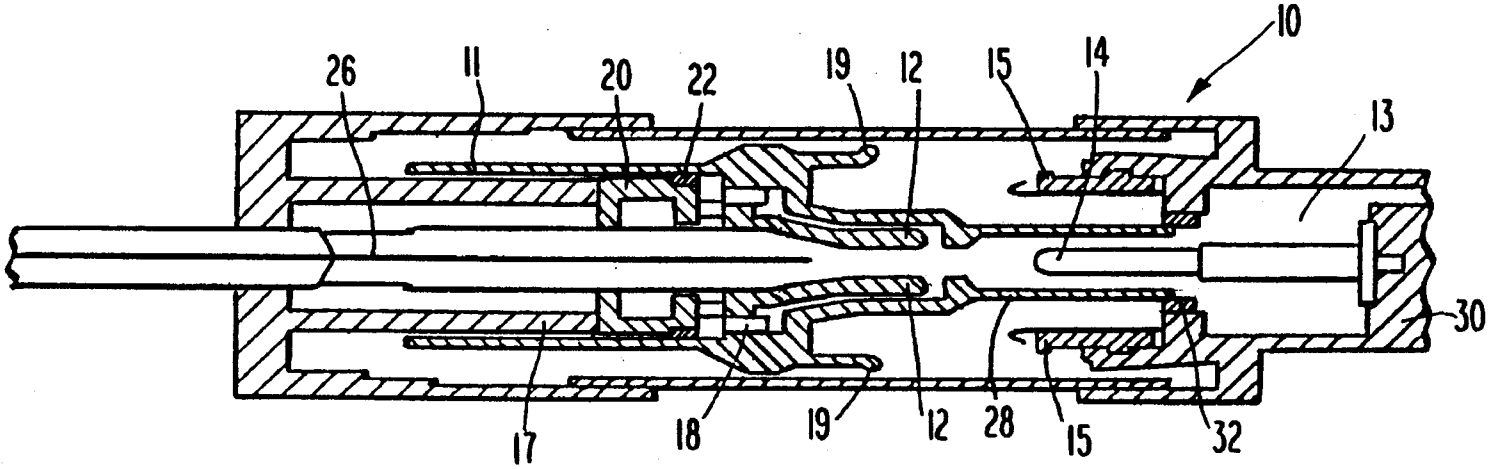
FIG. 6 is a longitudinal cross section of an interrupter with a guidance system according to the present invention in an open position.

FIGS. 4, 5, and 6 show a longitudinal cross section of an interrupter with a guidance system according to the present invention. As shown in the figures, a first guide 22 is used to stabilize the alignment between the movable contact system 11 and the contact support 20 as is described above. A second guide 32 is preferably positioned between the inner side of the main contact 15 of the stationary contact system and the nozzle 28 of the movable contact system to stabilize the alignment between the contact systems. Since the movable contact system and stationary contact system are aligned once the nozzle is received in the guide 32, it is unnecessary to manually align the stationary contact system with the movable contact system by trial and error. Nor is it necessary to mount the stationary contact system with the critical alignment.

The removal of the guide 24 permits the contact support 20 to self-adjust its alignment with respect to the exhaust tube so that the movable contact system and stationary contact system alignment is maintained even if the stationary contact system is not mounted with the critical alignment.

FIG. 4 shows the interrupter contacts in a closed position such that the main contact 15 of the stationary contact system and the main contact 19 of the movable contact system form an electrical interface. Similarly, the arcing contact 14 of the stationary contact system and the arcing contact 12 of the movable contact system form another electrical interface as shown.

When the circuit is opened, the movable contact system 11 is moved along the contact support so as to separate the movable contacts 12 and 19 from the stationary contacts as shown in FIG. 5. It should be understood that the movement of the movable contact system 11 can cause instability in the alignment between the movable contacts and the stationary contacts as they are separated if the guide ring 32 does not form a rigid guide for the contact systems.

As the movable contact system is guided along the contact support to a fully opened position as shown in FIG. 6, it is preferable that nozzle 28 remains engaged in guide 32 so that the movable contact system and stationary contact system will be aligned the next time the circuit is closed.

The guides also preferably function to seal off hot gases created by the interruption process. As explained above, it is important to provide a good seal to prevent the hot gases from entering the main contact region. Preferably, several seals are applied in a labyrinth arrangement.

Moreover, since the nozzle 28 is typically made of a plastic material such as polytetrafluoroethylene (PTFE), it is preferable that the guides likewise be made of a plastic material. It is also preferable to use plastic for the guides to reduce friction, to create non-conductive wear particles, and to prevent significant scraping that may be harmful to the nozzle. The guides material should also be flexible to permit easy assembly.

Figure 7:
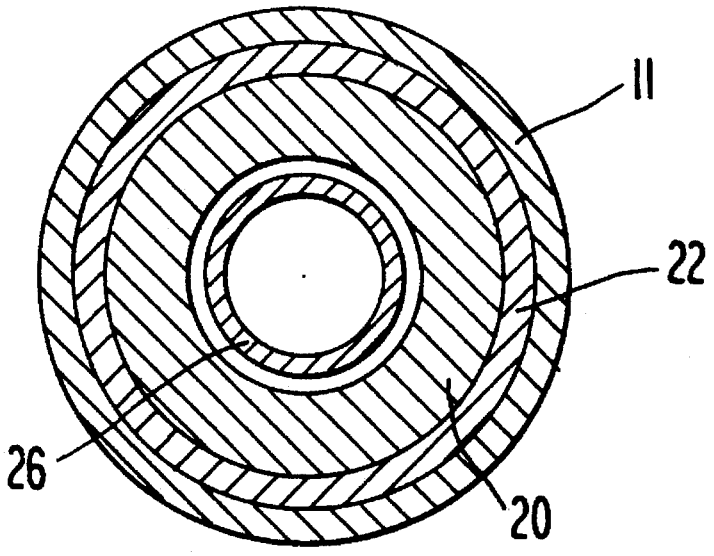
FIG. 7 is a cross section of an interrupter with guide ring positioned between the movable contact system and the contact support.
Figure 8:
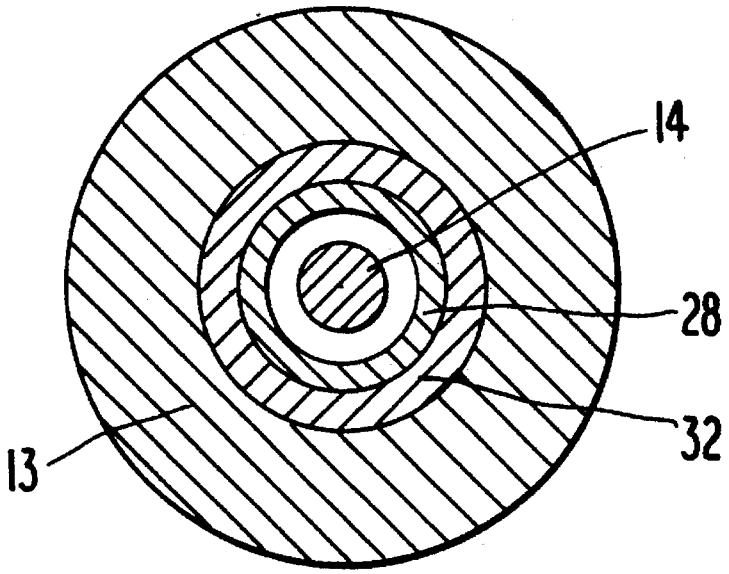
FIG. 8 is a cross section of a guide ring positioned between the stationary contact system and the nozzle of the movable contact system according to the present invention.

FIG. 7 is a cross section of the interrupter showing the guide 22 positioned between the movable contact system and the contact support. FIG. 8 is a cross section of the interrupter showing the guide 32 positioned in an opening of the stationary contact system.

While the invention has been described and illustrated with reference to specific embodiments, those skilled in the art will recognize that modification and variations may be made without departing from the principles of the invention as described hereinabove and set forth in the following claims.

What is claimed:

1. A guidance system for use in an interrupter having a movable contact system, a stationary contact system and a contact support, said movable contact system capable of moving along said contact support to form an interface with said stationary contact system, the guidance system comprising:

a first guide means for guiding said movable contact system along said contact support; and a second guide means for guiding said movable contact system relative to said stationary contact system so that said interface between said movable contact system and said stationary contact system remains stable.

2. The guidance system of claim 1, wherein said movable contact system comprises a nozzle formed from an insulating material and said stationary contact system comprises an arcing contact such that when said movable contact system is interfaced with said stationary contact system an electric field forms between said arcing contact and said nozzle, said first and second guide means substantially stabilizing said electric field while said movable contact system is guided along said contact support.

3. The guidance system of claim 1, wherein said first guide means is inserted between said contact support and said movable contact system so that said movable contact system is capable of being slidably moved along said contact support to provide a substantially fixed alignment therebetween.

4. The guidance system of claim 1, wherein said movable contact system comprises a nozzle, said second guide means being substantially fixed to said stationary contact system to receive said nozzle to align said movable contact system with said stationary contact system while said movable contact system is guided along said contact support.

5. The guidance system of claim 1, wherein said first and second guide means are substantially ring shaped.

6. The guidance system of claim 5, wherein said movable contact system comprises a nozzle, an arcing contact and a main contact and said stationary contact system comprises a main contact forming a substantially cylindrical frame and an arcing contact disposed along the central axis of said main contact of said stationary contact system, said second guide means being insertably fixed inside said main contact of said stationary contact system to receive said nozzle so that said main and arcing contacts of said movable contact system and said main and arcing contacts of said stationary contact system are substantially aligned when the movable contact system is guided along said contact support.

7. A method for assembling an interrupter comprising the steps of:

positioning a first guide means between a movable contact system and a contact support;

positioning a second guide means into an opening of a stationary contact system; and inserting at least a part of said movable contact system within said second guide means to align said movable contact system with said stationary contact system.

8. The method of claim 7, further comprising the step of:

operatively connecting said movable contact system to a driving mechanism.

9. The method of claim 7, further comprising the steps of:

mechanically securing said contact support within a housing at one end of said housing; and securing said stationary contact system at the other end of said housing so that said alignment between said stationary contact system and said movable contact system is self adjusting.

10. The method of claim 7, wherein said first and second guide means are ring shaped.

11. The method of claim 7, wherein said movable contact system comprises a nozzle, an arcing contact and a main contact and said stationary contact system comprises a main contact forming a cylindrical frame and an arcing contact disposed along the central axis of said main contact of said stationary contact system, said second guide means being insertably fixed inside said main contact of said stationary contact system to receive said nozzle so that said main and arcing contacts of said movable contact system and said main and arcing contacts of said stationary contact system are substantially aligned when the movable contact system is guided along said contact support.

12. The method of claim 7, wherein said movable contact system comprises a nozzle formed from an insulating material and said stationary contact system comprises an arcing contact such that when said movable contact system is interfaced with said stationary contact system an electric field forms between said arcing contact and said nozzle, said first and second guide means being positioned so that said electric field is substantially stable while said movable contact system is guided along said contact support.

13. A switch interrupter comprising:

a contact support;

a movable contact system positioned to move along said contact support:

a first guide means disposed between said contact support and said movable contact system to align said movable contact system with said contact support;

a stationary contact system for receiving said movable contact system; and a second guide means substantially fixed to said stationary contact system to align said movable contact system with said stationary contact system.

14. The interrupter of claim 13, further comprising:

a housing in which said contact support, movable contact system, and stationary contact system are disposed.

15. The interrupter of claim 14, wherein said stationary contact system is secured to said housing so that said alignment between said movable contact system and said stationary contact system is self-adjusting.

16. The interrupter of claim 13, wherein said first and second guide means are rings formed from a substantially insulating material.

* * * * *